US007325773B2

(12) United States Patent
Gorrie

(10) Patent No.: US 7,325,773 B2
(45) Date of Patent: Feb. 5, 2008

(54) KITE WINCH AND METHOD FOR PULLING-IN A KITE

(75) Inventor: John Robert Gorrie, Gilbert, AZ (US)

(73) Assignee: Gregory J. Gorrie, Gilbert, AZ (US)

( * ) Notice: Subject to any disclaimer, the term of this patent is extended or adjusted under 35 U.S.C. 154(b) by 0 days.

(21) Appl. No.: 11/171,526

(22) Filed: Jun. 30, 2005

(65) Prior Publication Data

US 2007/0001056 A1 Jan. 4, 2007

(51) Int. Cl.
*A63H 27/08* (2006.01)

(52) U.S. Cl. ..... 244/155 A; 244/155 R

(58) Field of Classification Search ..... 244/155 R, 244/155 A; 242/564.4, 611, 354; 254/358
See application file for complete search history.

(56) References Cited

U.S. PATENT DOCUMENTS 220,844 A * 10/1879 Jackman ..... 254/358
1,296,687 A * 3/1919 Nichols ..... 340/384.7
2,436,510 A * 2/1948 Ferguson ..... 254/227
2,869,822 A * 1/1959 Shurtliff ..... 254/358
3,549,199 A * 12/1970 Sibley ..... 296/98
4,069,719 A * 1/1978 Cancilla ..... 474/134
4,796,862 A * 1/1989 Peppel ..... 254/277
2003/0121198 A1* 7/2003 Watermann ..... 43/1
2003/0154944 A1* 8/2003 Palesch et al. ..... 123/90.17

* cited by examiner

*Primary Examiner*—Tien Dinh
(74) *Attorney, Agent, or Firm*—Schwegman, Lundberg & Woessner, P.A.

(57) ABSTRACT

A kite winch allows a kite to be pulled-down from a high-elevation with reduced effort. The kite winch includes first and second sprockets coupled by a chain. The second sprocket has a larger diameter than the first sprocket. A spool for retaining kite string may be coupled with the second sprocket. A handle may be coupled with the first sprocket. When the handle is turned, the first sprocket engages the chain which in turn engages the second sprocket thereby turning the spool pulling-down the kite. An internal ratcheting mechanism within the first sprocket may selectively allow rotation of the first sprocket in one direction. A locking pin may selectively lock the second sprocket wheel to hold the string at a constant length. One or more adjustable chain tensioners may reduce slack in the chain by exerting at least a slight pressure on the chain.

2 Claims, 1 Drawing Sheet

KITE WINCH AND METHOD FOR PULLING-IN A KITE

TECHNICAL FIELD

The present inventions pertain to kites, and particularly to methods and apparatus for pulling-in kites.

BACKGROUND

Flying a kite is a fun activity. Many kite fliers desire to fly their kits higher and higher. One difficult with flying a kite very high is that there is an increasingly greater force required to pull-in the kite. For example, when several hundred and even several thousand feet of kite string is let out, the force required to pull-in the kite is significant. Conventional kite reels do not have any way of applying this amount force. This results in the user pulling the string in by hand and wrapping it around the reel causing the string to dig into the user's hand possibly damaging the skin.

Thus, there are general needs for apparatus and methods that make it easier to pull-in a kite, especially when the kite is flying very high. There are also needs for apparatus and methods that hold sufficient string to allow a kite to fly very high while providing a means to pull-in the kite when flown high.

SUMMARY OF THE INVENTION

A kite winch allows a kite to be pulled-down from a high-elevation with reduced effort. The kite winch includes first and second sprockets coupled by a chain. The second sprocket may have a larger diameter than the first sprocket. The kite winch may also include a spool for retaining kite string coupled with the second sprocket, and a handle coupled with the first sprocket. When the handle is turned, the first sprocket engages the chain which in turn engages the second sprocket thereby turning the spool pulling-down the kite. The kite winch may include an internal ratcheting mechanism within the first sprocket to selectively allow rotation of the first sprocket in one direction, a locking pin to selectively lock the second sprocket to hold the string at a constant length, and one or more adjustable chain tensioners to reduce slack in the chain by exerting at least a slight pressure on the chain. The kite winch may also include a clip to allow kite to be coupled and decoupled from the kite string on the spool.

DETAILED DESCRIPTION

Figure 1:
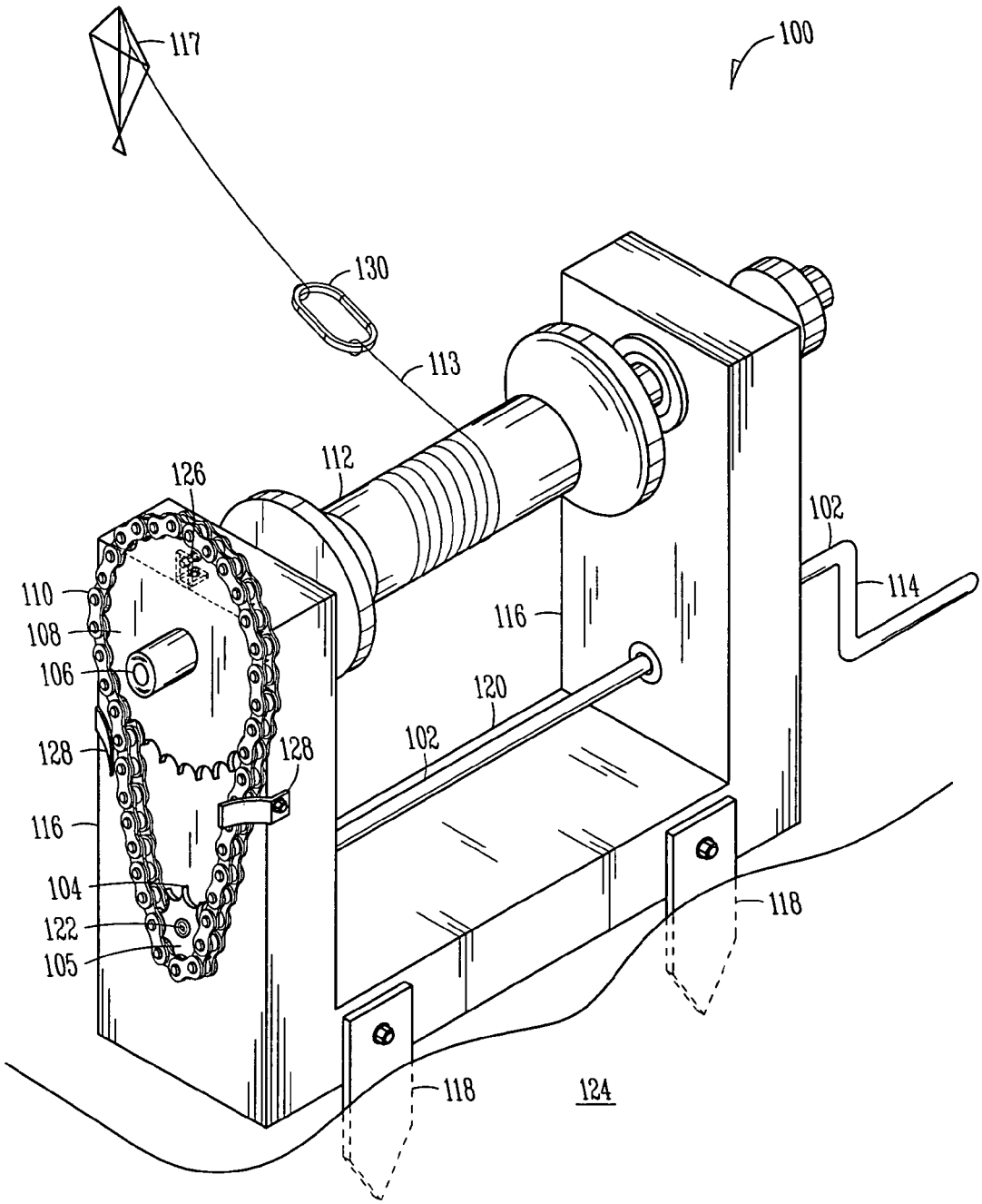
FIG. 1 is a perspective view of a kite winch in accordance with some embodiments of the present invention.

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to limit the scope of this application to any single invention or inventive concept if more than one is in fact disclosed.

FIG. 1 is a perspective view of a kite winch in accordance with some embodiments of the present invention. Kite winch 100 may be used to pull-in kite 117 from high elevations. In some embodiments, kite winch 100 includes first shaft 102 coupled to first sprocket wheel 104 and second shaft 106 coupled to second sprocket wheel 108. Second sprocket wheel 108 may have a larger diameter than the first sprocket wheel 104, although the scope of the invention is not limited in this respect. Kite winch 100 may also include chain 110 coupling both sprocket wheels and spool 112 for retaining kite string 113 around second shaft 106. Kite winch 100 may also include handle 114 coupled to first shaft 102 such that when handle 114 is turned, first sprocket wheel 104 engage chain 110 which in turn engages second sprocket wheel 108 thereby turning spool 112 allowing kite 117 to be pulled-down with reduced effort. The use of kite winch 100 may allow a kite to be easily pulled-down from high elevations.

In some embodiments, first sprocket wheel 104 may be a ratcheting sprocket wheel comprising an internal ratcheting mechanism 105 to selectively allow rotation in one direction and to allow the handle to operate as a ratchet. In some embodiments, first sprocket wheel 104 may have a switch (not separately illustrated) to allow internal ratcheting mechanism 105 to be selected to allow rotation in either direction. Internal ratcheting mechanism 105 may allow kite 117 to be let out when one position is selected without having to rotate handle 114. When the other position is selected, this may allow handle 114 to operate as a ratchet to pull-in kite 117 and prevent kite 117 from being let out further.

In some embodiments, kite winch 100 may also include locking pin 126 to selectively lock second sprocket wheel 108 to hold string 113 at a constant length. In this way, kite 117 may be easily held at a fixed elevation.

In some embodiments, kite winch 100 may also include a clip 130 to allow kite 117 to be coupled and decoupled from kite string on spool 112. In this way, kite 117 can be initially launched without kite winch 100 and once flying, can be coupled to kite winch 100 by clip 130.

In some embodiments, kite winch 100 may also include receiver 122 at an end of either the first or the second shafts. Receiver 122 may be configured to receive either a square or hexagonal insert for an electric hand-held drill. In these embodiments, the use of an electric drill may allow kite 117 to be retrieved more quickly than using handle 114 and may allow the string to be wound more quickly around spool 112.

In some embodiments, kite winch 100 may also include one or more adjustable chain tensioners 128 to reduce slack in chain 110 by exerting at least a slight pressure on chain 110. In some embodiments, a first chain of tensioners 128 may be mounted on one side of mounting brace 116 and a second of chain tensioners 128 may be mounted on an opposite side of mounting brace 116.

Mounting braces 116 and mounting platform 120 may be configured to separate and to support the first and second shafts 102 and 106. Locking pin 126 may be coupled to one of mounting braces 116.

In some embodiments, kite winch 100 may also include a plurality of ground-coupling wedges 118 to couple mounting platform 120 to earth 124. Ground-coupling wedges 118 may hold kite winch 100 to the ground and may prevent it from being lifted by kite 117.

In some embodiments, handle 114 and first and second shafts 102 and 106 may comprise plastic or PVC pipe, although other materials may also be used. In some embodiments, mounting braces 116, mounting platform 120 and ground-coupling wedges 118 may comprise wood, although other materials may also be used.

Although FIG. 1 illustrates kite winch 100 with sprocket wheels 104 and 108 coupled by chain 110, in other embodiments, pulleys coupled with a belt may be used. In other embodiments, meshed gears may be used.

Some embodiments of the present invention provide an apparatus for use in flying a kite. In these embodiments, the apparatus may comprise first and second sprockets coupled by a chain. The second sprocket may have larger diameter than the first sprocket. The apparatus may also include a spool for retaining kite string coupled with the second sprocket. The apparatus may also include a handle coupled with the first sprocket. When the handle is turned, the first sprocket engages the chain which in turn engages the second sprocket thereby turning the spool allowing a kite to be pulled-down from a high-elevation with reduced effort.

Some embodiments of the present invention provide a method for pulling-in a kite from a high-elevation. In these embodiments, the method comprises turning a handle coupled to a first sprocket. The first sprocket engages a chain which in turn engages a second sprocket having a larger diameter than the first sprocket. The second sprocket turns a spool retaining kite string to pull-down the kite from a high-elevation with reduced effort. The method may also comprise selecting a position for an internal ratcheting mechanism within the first sprocket to selectively allow rotation of the first sprocket in one direction and locking the second sprocket wheel to hold the string at a constant length. The method may also include adjusting slack in the chain by exerting at least a slight pressure on the chain with one or more adjustable chain tensioners. The method may also include coupling the kite string to separate string on the spool with a clip.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. A kite winch comprising:

a first shaft coupled to a first sprocket wheel;

a second shaft coupled to a second sprocket wheel, the second sprocket wheel having a larger diameter than the first sprocket wheel;

a chain coupling both sprocket wheels;

a spool for retaining kite string around the second shaft;

a handle coupled to the first shaft:

a locking pin to selectively lock the second sprocket wheel to hold the string at a constant length;

adjustable chain tensioners to reduce slack in the chain by exerting at least a slight pressure on the chain; and a clip to allow a kite to be coupled and decoupled from the kite string on the spool, wherein when the handle is turned, the first sprocket wheel engages the chain which in turn engages the second sprocket wheel thereby turning the spool allowing the kite to be pulled-down with reduced effort, wherein the first sprocket wheel is a ratcheting sprocket wheel comprising an internal ratcheting mechanism to selectively allow rotation in one direction and to allow the handle to operate as a ratchet, wherein the kite winch further comprises:

a receiver at an end of either the first or the second shafts, the receiver to receive either a square or hexagonal insert for an electric hand-held drill;

mounting braces and a mounting platform to separate and to support the first and second shafts; and a plurality of ground-coupling wedges to couple the mounting platform to earth, wherein the locking gin is coupled to one of the mounting braces, wherein the one or more chain tensioners is coupled to one of the mounting braces, wherein the handle and the first and second shafts comprise plastic or PVC pipe, wherein the mounting braces, the mounting platform and the ground-coupling wedges comprise wood, and wherein a first of the chain tensioners is mounted on one side of the one mounting brace and a second of the chain tensioners is mounted on an opposite side of the one mounting brace.

2. An apparatus to fly a kite comprising:

first and second sprockets coupled by a chain, the second sprocket having a larger diameter than the first sprocket;

a spool for retaining kite string coupled with the second sprocket;

a handle coupled with the first sprocket;

an internal ratcheting mechanism within the first sprocket to selectively allow rotation of the first sprocket in one direction and allow the handle to operate as a ratchet;

a locking pin to selectively lock the second sprocket wheel to hold the string at a constant length;

one or more adjustable chain tensioners to reduce slack in the chain by exerting at least a slight pressure on the chain;

a clip to allow kite to be coupled and decoupled from the kite string on the spool;

a first shaft coupled to the first sprocket;

a second shaft coupled to the second sprocket, the spool being located around the second shaft and the handle is coupled to an end of the first shaft;

mounting braces and a mounting platform to separate and to support the first and second shafts, both the first and second shafts going through both the first and second mounting braces; and ground-coupling wedges to couple the mounting platform to earth, the ground coupling wedges to prevent the apparatus from being lifted by the kite, wherein when the handle is turned, the first sprocket engages the chain which in turn engages the second sprocket thereby turning the spool allowing the kite to be pulled-down from a high-elevation with reduced effort, wherein the locking pin is coupled to one of the mounting braces and the one or more chain tensioners is coupled to one of the mounting braces; a receiver at an end of either the first or second shafts, the receiver to receive either a square or hexagonal insert for an electric hand-held drill.

* * * * *

UNITED STATES PATENT AND TRADEMARK OFFICE

CERTIFICATE OF CORRECTION

PATENT NO. : 7,325,773 B2
APPLICATION NO. : 11/171526
DATED : February 5, 2008
INVENTOR(S) : Gorrie It is certified that error appears in the above-identified patent and that said Letters Patent is hereby corrected as shown below:

Column 1, line 12, delete “kits” and insert -- kites --, therefor.

Column 3, line 59, in Claim 1, delete “shaft:” and insert -- shaft; --, therefor.

Column 4, line 15, in Claim 1, delete “gin” and insert -- pin --, therefor.

Signed and Sealed this

Twentieth Day of May, 2008

JON W. DUDAS
*Director of the United States Patent and Trademark Office*